US007757341B2

(12) United States Patent
Bober et al.

(10) Patent No.: US 7,757,341 B2
(45) Date of Patent: Jul. 20, 2010

(54) SPOT REMOVAL DEVICE

(75) Inventors: Andrew M. Bober, Racine, WI (US); Peter Y. Mizuki, Racine, WI (US)

(73) Assignee: Diversey, Inc., Sturtevant, WI (US)

( * ) Notice: Subject to any disclaimer, the term of this patent is extended or adjusted under 35 U.S.C. 154(b) by 1137 days.

(21) Appl. No.: 11/305,638

(22) Filed: Dec. 16, 2005

(65) Prior Publication Data

US 2006/0130271 A1 Jun. 22, 2006

Related U.S. Application Data

(60) Provisional application No. 60/638,566, filed on Dec. 22, 2004.

(51) Int. Cl.
*A47L 7/00* (2006.01)
*A47L 11/40* (2006.01)

(52) U.S. Cl. ..... 15/320; 15/410

(58) Field of Classification Search ..... 15/320, 15/321, 410

See application file for complete search history.

(56) References Cited

U.S. PATENT DOCUMENTS

| | | | | | |
|---|---|---|---|---|---|
| 3,456,279 | A | | 7/1969 | Koland, et al. | 15/320 |
| 4,295,243 | A | * | 10/1981 | King | 15/320 |
| 4,724,573 | A | * | 2/1988 | Ostergaard | 15/321 |
| 4,980,815 | A | * | 12/1990 | Davis | 700/11 |
| 5,168,599 | A | | 12/1992 | Williams | 15/346 |
| 5,301,386 | A | * | 4/1994 | Thomas et al. | 15/321 |
| 5,799,362 | A | | 9/1998 | Hubbman | 15/321 |
| 6,206,980 | B1 | | 3/2001 | Robinson | 134/21 |
| 7,051,399 | B2 | * | 5/2006 | Field et al. | 15/320 |
| 7,091,932 | B2 | * | 8/2006 | Astrauskas | 345/30 |
| 7,228,589 | B2 | * | 6/2007 | Miner et al. | 15/320 |
| 7,362,064 | B2 | * | 4/2008 | Coates et al. | 318/286 |
| 2001/0000576 | A1 | | 5/2001 | Robinson | 134/169 |
| 2003/0019070 | A1 | | 1/2003 | Field et al. | 15/320 |
| 2003/0159231 | A1 | | 8/2003 | Oh | 15/320 |
| 2004/0025284 | A1 | | 2/2004 | Courtney et al. | 15/320 |
| 2004/0031123 | A1 | | 2/2004 | Sclafani et al. | 15/320 |
| 2004/0111821 | A1 | | 6/2004 | Lenkiewicz et al. | 15/320 |
| 2005/0160556 | A1 | * | 7/2005 | Hitzelberger et al. | 15/389 |
| 2006/0179599 | A1 | * | 8/2006 | Miner et al. | 15/320 |

FOREIGN PATENT DOCUMENTS

| | | | |
|---|---|---|---|
| WO | WO 03/033179 | A1 | 4/2003 |

* cited by examiner

*Primary Examiner*—David B Thomas
(74) *Attorney, Agent, or Firm*—Gregory S. Bollis

(57) ABSTRACT

An extraction cleaning device housing multiple cleaning solutions that can dispensed by manipulation of a control coupled to the extraction device. Multiple cleaning solution supply reservoirs are coupled to the cleaning device and in fluid communication with a dispensing head. Through the use of the control, an operator can select a specific cleaning solution for a specific application. Manipulation of the control allows for nearly instantaneous conversion between cleaning solutions for different applications. Some embodiments of the cleaning device have a housing with an end that engages the ground during cleaning operations. The housing at least partially contains several cleaning solution supply reservoirs, a rinse fluid reservoir, and an extracted fluid reservoir. A vacuum source can also be housed within the housing.

12 Claims, 13 Drawing Sheets

SPOT REMOVAL DEVICE

CROSS REFERENCE TO RELATED APPLICATIONS

This claims priority to U.S. provisional patent applications No. 60/638,566 filed on Dec. 22, 2004, which is hereby incorporated by reference.

BACKGROUND OF THE INVENTION

Water extraction cleaning machines are used for cleaning a variety of surfaces such as carpet, upholstery, bare floors, and the like. Some conventional water extraction cleaning machines have a housing that supports a single cleaning solution supply reservoir. During the cleaning process, the cleaning solution is sprayed onto the surface to be cleaned and then a vacuum removes at least a portion of the solution along with dirt entrained in the solution.

One problem with these conventional extraction cleaning machines is that only one cleaning solution can be carried within the housing, while different stains, spots, or other types of soiling can require different types of cleaning solutions. Accordingly, during a single cleaning operation, one may encounter a spot that is not extracted by the current cleaning solution. Thus, to properly extract the spot, the cleaning solution within the housing must be changed. To change cleaning solutions, one solution must be removed from the housing and a second solution must be introduced to the housing. This process of removing one solution and introducing another solution can be inefficient and inconvenient to the user.

SUMMARY OF THE INVENTION

The present invention relates to an extraction cleaning device housing multiple cleaning solutions simultaneously. The extraction cleaning device can dispense each solution by manipulation of a control coupled to the extraction device. In some embodiments, the control is a dial that allows the user to select among the various cleaning solutions.

The extraction cleaning device according to the invention overcomes the problems with conventional extraction cleaning devices by having multiple cleaning solution supply reservoirs coupled to the cleaning device and in fluid communication with a dispensing head. Through the use of a control, an operator can select among the various cleaning solutions for different cleaning applications. Manipulation of the control allows for nearly instantaneous conversion between cleaning solutions for different applications. Due to this arrangement, an operator can use one or more cleaning solutions on a spot or noticeably soiled area to effectively remove the spot.

Some embodiments of the cleaning device have several cleaning solution supply reservoirs, a rinse solution supply reservoir, and an extracted fluid reservoir, all cooperatively arranged on the device. The cleaning device can also be equipped with a vacuum source as well as fluid delivery devices, such as pumps and the like. Additionally, the cleaning device also has an agitation device, such as a rotating brush, to assist with spot removal.

Further aspects of the present invention, together with the organization and operation thereof, will become apparent from the following detailed description of the invention when taken in conjunction with the accompanying drawings.

DETAILED DESCRIPTION

Figure 1:
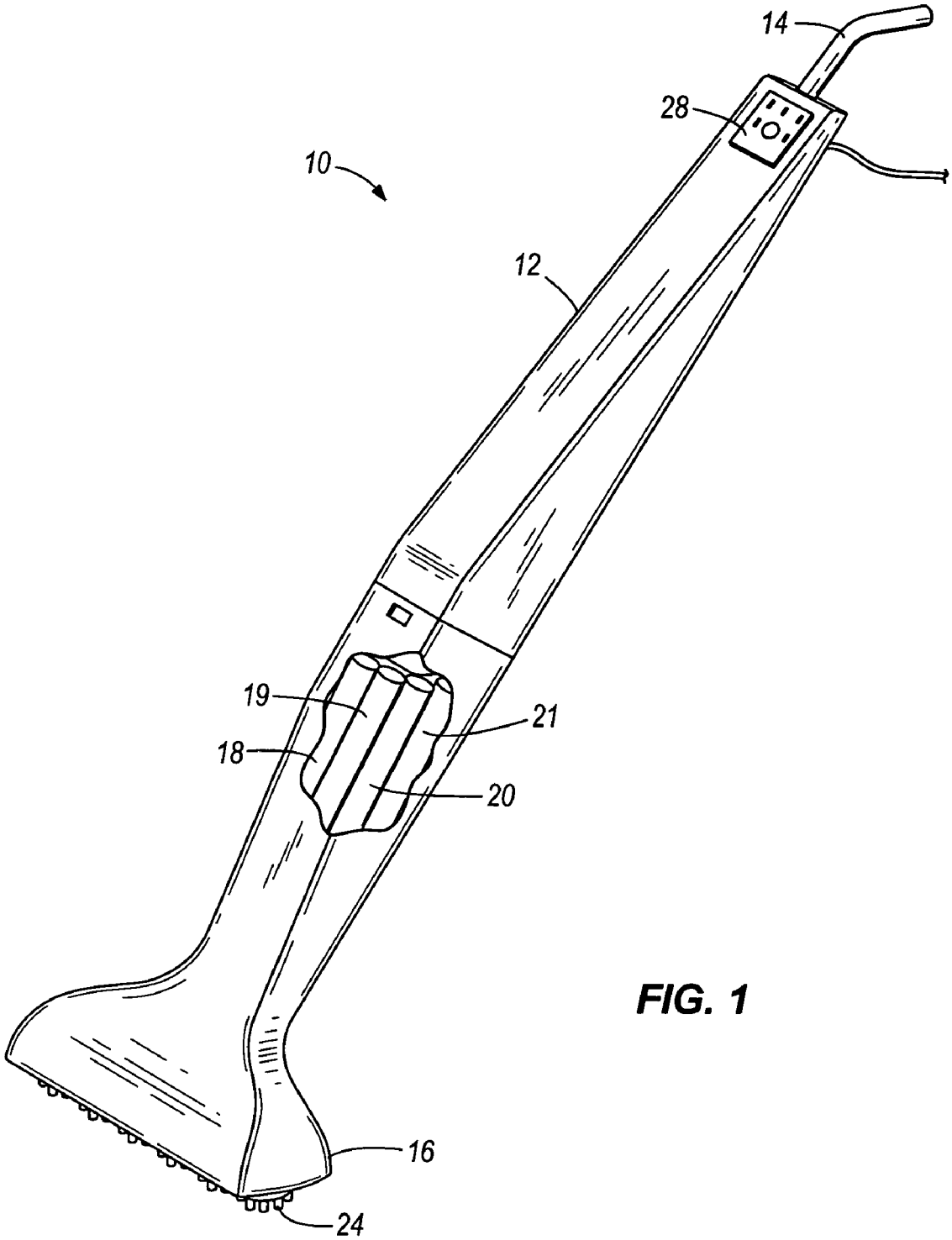
FIG. 1 is perspective view of an extraction cleaning device embodying aspects of the present invention, wherein a portion of the housing is broken away.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising," or "having" and variations thereof herein is meant to encompass the items listed thereafter and equivalents thereof as well as additional items. The terms "mounted," "connected," and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Finally, as described in subsequent paragraphs, the specific mechanical configurations illustrated in the drawings are intended to exemplify embodiments of the invention. Accordingly, other alternative mechanical configurations are possible, and fall within the spirit and scope of the present invention.

Figure 2:
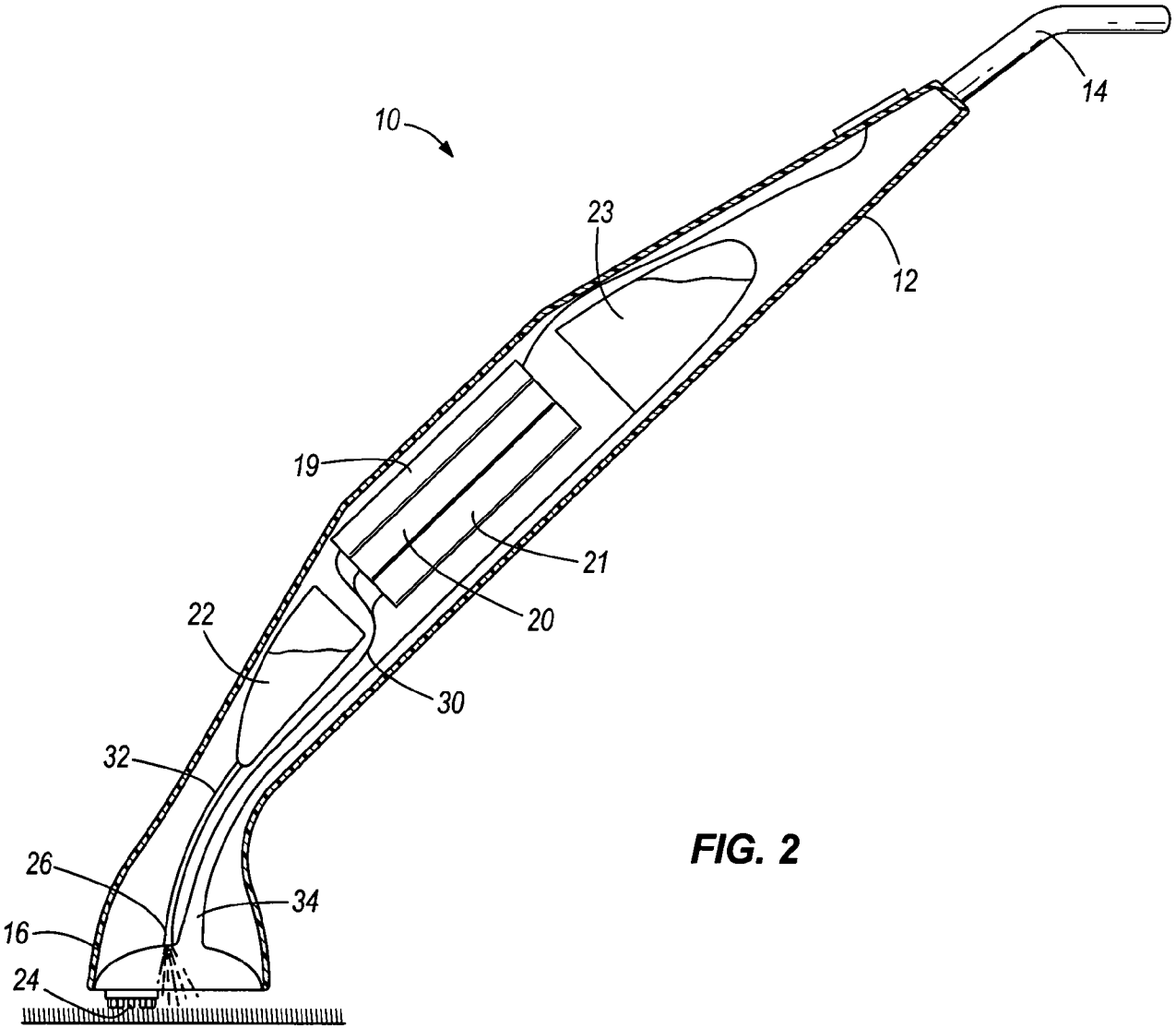
FIG. 2 is cross-sectional side view of the extraction cleaning device shown in FIG. 1.

An extraction cleaning device 10 embodying aspects of the invention is shown in FIGS. 1 and 2. The extraction cleaning device 10 has a housing 12 having a generally elongated shape. A handle 14 is located at one end of the housing 12 and a head 16 adapted for engagement with the floor or other support surface is positioned at the other end of the housing 12. The housing 12 at least partially contains several cleaning solution reservoirs 18-21, a rinse fluid reservoir 22, and an extracted fluid reservoir 23 in an efficient and compact manner. Furthermore, other devices, such as an agitation device 24, dispensing head 26, and vacuum source (not shown) are contained within or coupled to the housing 12. Finally, a control 28 is coupled to the housing 12 of the cleaning device 10 to allow an operator to selectively control the operation of the cleaning device 10.

In the illustrated embodiment, the cleaning device 10 is provided with four cleaning solution reservoirs 18-21. Some embodiments of the invention can be equipped with more or fewer cleaning solution reservoirs. Each reservoir 18-21 is adapted to hold one of a variety of different cleaning solutions. Accordingly, in the illustrated embodiment, four different cleaning solutions can be contained within the cleaning device 10. However, in some uses, more than one reservoir can contain the same cleaning solution.

The reservoirs 18-21 can be configured several different ways. For example, they can be rigidly fixed to the cleaning device 10 to prevent removal of the reservoirs 18-21 from the cleaning device 10. Accordingly, the reservoirs 18-21 in such an embodiment would be refillable via removal of a threaded cap or other arrangement. In another configuration, the reservoirs 18-21 can be selectively removed from the housing 12. Depending upon the desired construction of the reservoirs 18-21, they could be refilled when removed or replaced with another reservoir. Accordingly, in some embodiments, each reservoir could be disposed of when empty and replaced with another filled reservoir.

Regardless of the specific configuration (i.e., fixed/removable or refillable/disposable) of the reservoirs 18-21, the reservoirs 18-21 are coupled to the cleaning device 10 for fluid communication with a dispensing head 26. The reservoirs 18-21 are placed in fluid communication with the dispensing head 26 via one or more conduits 30 extending between the reservoirs 18-21 and the dispensing head 26. The cleaning solutions can be delivered through the conduit 30 via a pump, gravity, pressure differentials, and the like. Accordingly, one or more valves (not shown) can control the discharge of the cleaning solution from each reservoir 18-21 to the dispensing head 26. Furthermore, operation of each valve can be controlled by the control 28. The operator can select which solution to dispense by manipulating the control 28, which will then cause the appropriate valve to open to allow a particular cleaning solution to be dispensed. The choice of solution to be dispensed can be dependent upon the type of stain, spot, or soil encountered. If the stain cannot be identified, several different solutions can be utilized in succession without the need to change cleaning solutions contained within the cleaning device 10.

Figure 8A:
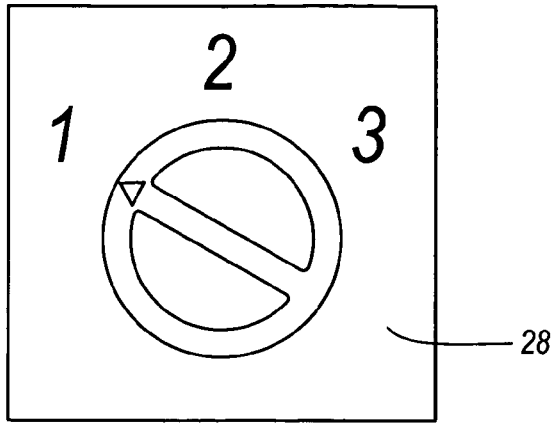
FIG. 8 is a perspective view of a control for use with a cleaning device embodying aspects of the invention.
Figure 8B:
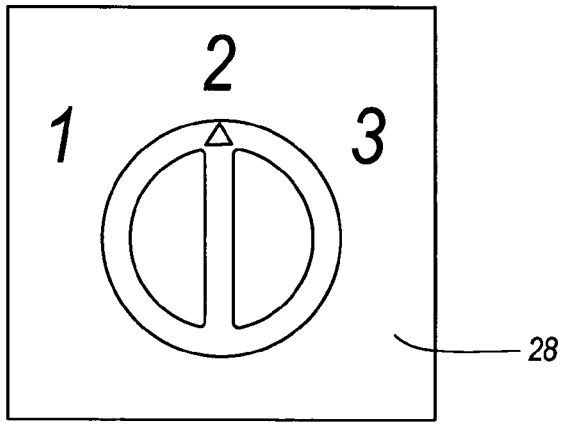
Figure 8C:
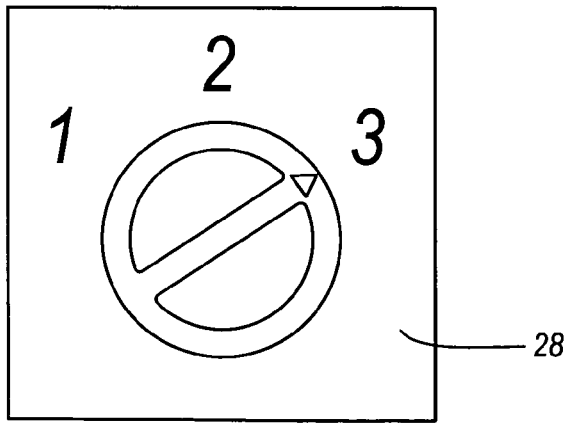

The control 28 can be configured several different ways. For example, it can be provided with a variety of push buttons, a dial, a combination of both, and the like to select specific solutions to dispense. Furthermore, the control 28 can have a touch screen display or other display with adjacent buttons to allow selection of options on the display. FIG. 8 shows one particular embodiment of a dial type control 28.

Some embodiments of the cleaning device 10 are provided with an agitation device 24 to assist with cleaning operations, such as spot removal. The agitation device 24 can include a variety of different structures. For example, linear or rotary brushes can be used as the agitation device 24, as well as scrubbing pads and the like. The choice of agitation device 24 can be dependent upon the surface being cleaned. In the embodiment illustrated in FIGS. 1 and 2, rotary brushes are selectively driven to agitate the cleaning solution on the area having a spot. Although the brushes are described as being selectively driven, in some embodiments, the brushes can be continuously driven during operation of the cleaning device.

The illustrated cleaning device 10 also has a rinse fluid reservoir 22 that contains a rinse solution. The rinse solution to be applied to the spot to assist with removal. Generally, the rinse solution is applied after or during the agitation process. However, it can be applied at other times if needed. The rinse fluid reservoir 22 can be configured several different ways. For example, it can be rigidly fixed or it can be selectively removed from the housing 12 to be refilled.

The rinse fluid reservoir 22 is in fluid communication with a dispensing head 26. As indicated in FIG. 2, the rinse solution dispensing head 26 can be the same dispensing head used for the cleaning solution. However, in other embodiments, the rinse fluid can be dispensed via a separate dispensing head. The rinse fluid reservoir 22 is placed in fluid communication with the dispensing head 26 via a conduit 32 extending between the reservoir 22 and the dispensing head 26. The rinse fluid can be delivered through the conduit 32 via a pump, gravity, pressure differentials, and the like. Accordingly, one or more valves (not shown) can control the discharge of the rinse fluid from the reservoir 22. Operation of the valve can be selective controlled by the control 28 or other actuator.

A vacuum motor (not shown) is contained within the housing 12 of the cleaning device 10. The vacuum motor supplies suction to the head 16 to remove and/or extract debris or soil from the floor. The vacuum motor provides suction to the head 16 via a conduit 34. The conduit 34 extends from the head 16 to the extracted fluid reservoir 23. While the vacuum motor provides vacuum to the head 16, matter is lifted from the floor and delivered to the extracted fluid reservoir 23 via the conduit 34. The vacuum can lift the dispensed cleaning and rinse solutions along with any debris or extracted materials.

Items needing power within the cleaning device, such as the vacuum motor, can be powered by a direct electrical connection such as an electrical plug or by battery power. If battery power is utilized, the cleaning device can be provided with an electrical connection to allow the batteries to be recharged on a recharger. The batteries in some embodiments can include a removable battery pack, where the battery pack is removed for recharging. In other embodiments, the batteries can be recharged by attaching the cleaning device 10 to a charger or docking station.

Like the other reservoirs 18-22, the extracted fluids reservoir 23 is at least partially contained within the housing 12 and can be configured many different ways. However, this reservoir 23 should generally be removable from the housing 12 to allow the contents of the reservoir 23 to be easily removed. In some embodiments, though, the reservoir 23 can be rigidly fixed to the housing 12. In such an embodiment, the reservoir 23 can be equipped with a drain line to allow contents of the reservoir 23 to be removed.

FIGS. 3-7 illustrate a second embodiment of a cleaning device embodying aspects of the invention. This embodiment has many similarities to the previous embodiment. Accordingly, similar elements will be given similar reference numerals. However, this does not dictate that these elements must be identical in configuration or operation. Furthermore, since most of the elements were discussed with respect to the previous embodiment, certain details may be omitted for the sake of brevity.

Figure 3:
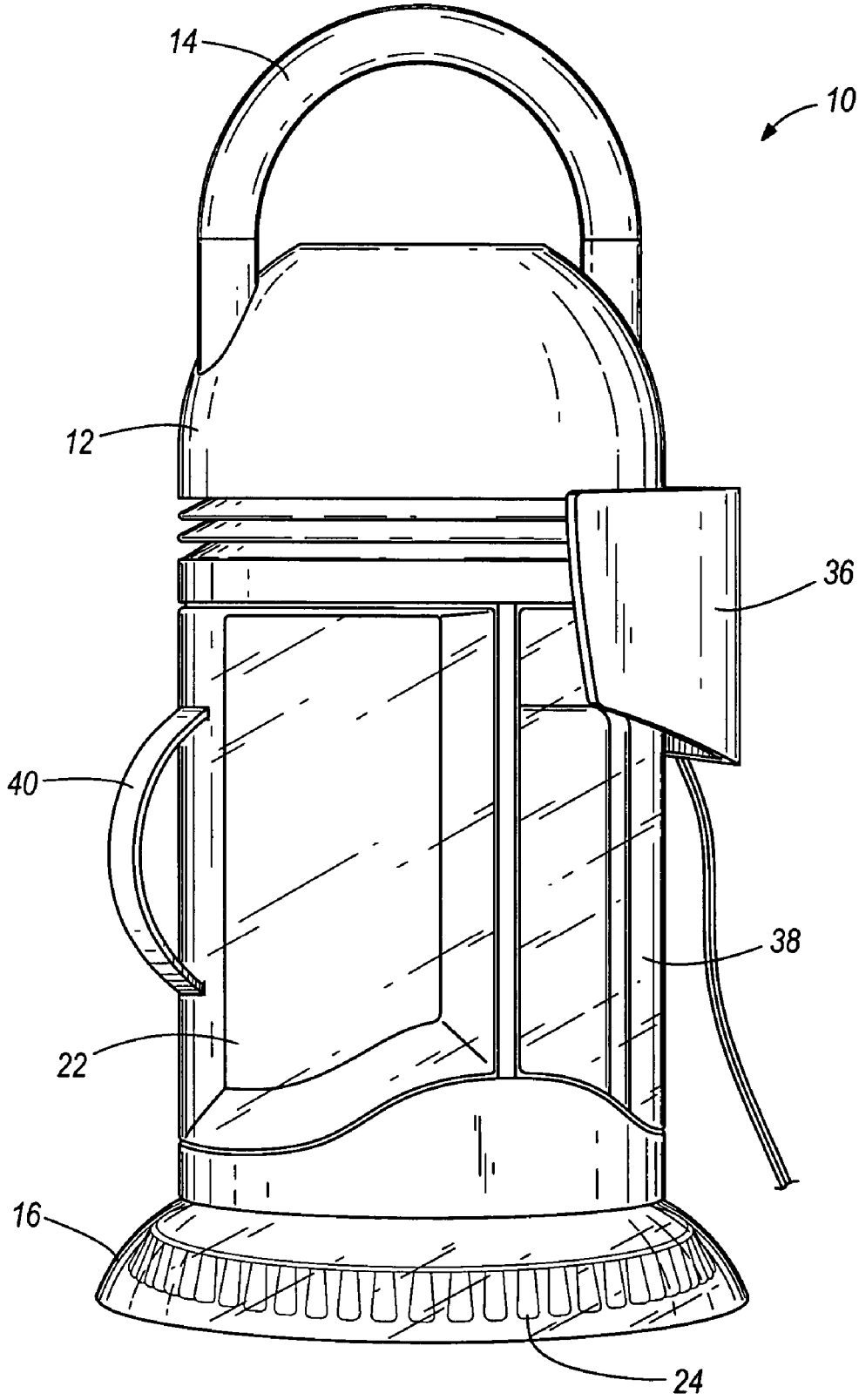
FIG. 3 is a perspective view of a second embodiment of an extraction cleaning device embodying aspects of the present invention, where the cleaning device is coupled to a charger.

FIG. 3 shows the cleaning device 10 coupled to a charger or docking station 36. The housing 12 of this embodiment has a generally cylindrical shape. A handle 14 is located at one end of the housing 12. A head 16 is coupled to the opposite end of the housing 12 and is adapted for engagement with the floor or other support surface. The housing 12 of this embodiment has movable panel 38 that allows access to three cleaning solution reservoirs 18-20 positioned within the housing 12 behind the panel 38. The panel 38 can be made from translucent materials to allow an operator to easily view the cleaning solutions contained within the housing 12. Additionally, a removable rinse fluid reservoir 22 is at least partially contained within the housing.

Figure 4:
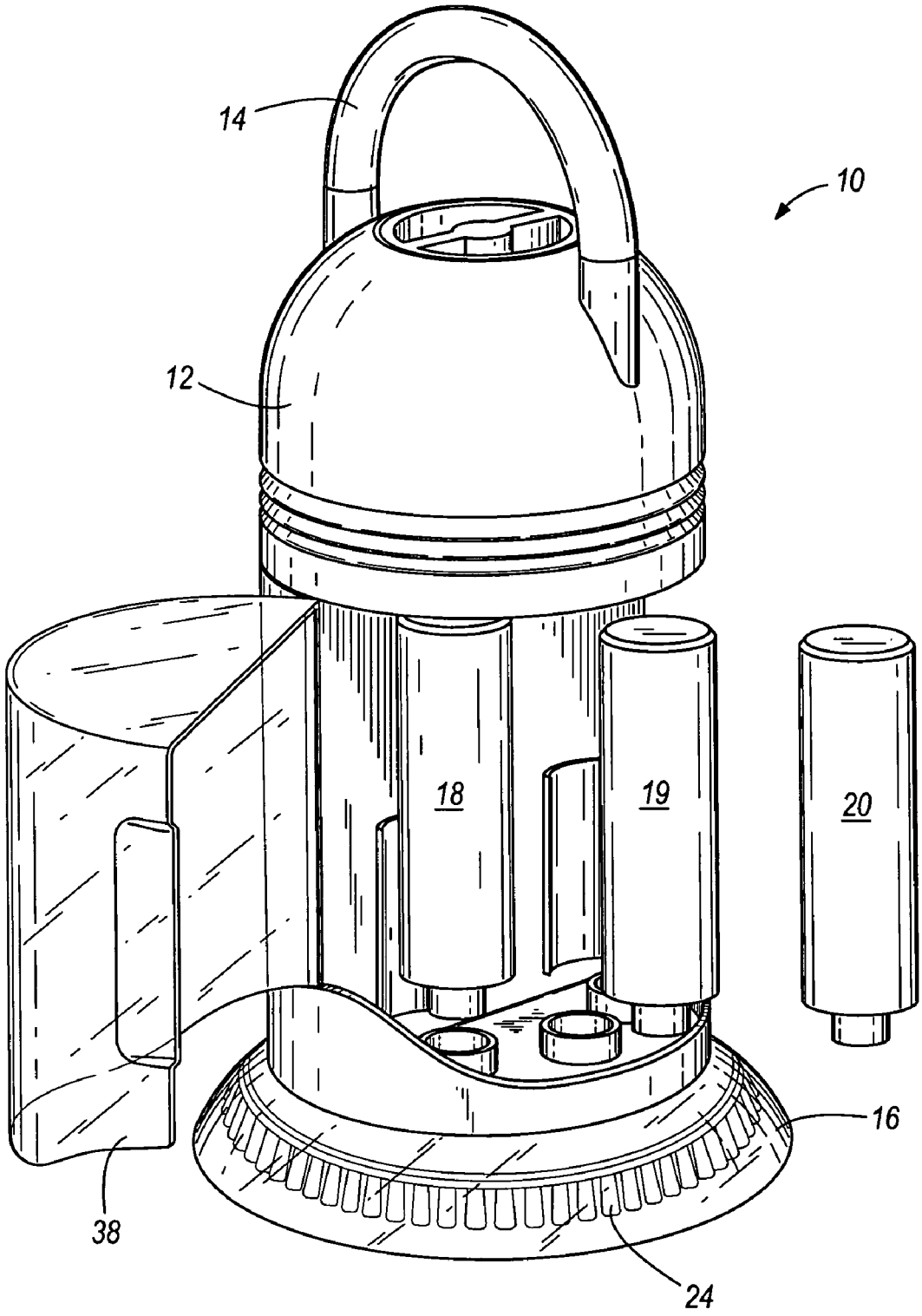
FIG. 4 is a partially exploded perspective view of the cleaning device shown in FIG. 3.

As illustrated in FIG. 4, each cleaning solution reservoir 18-20 of this embodiment can be selectively removed, refilled, and/or replaced. Furthermore, the reservoirs 18-20 can be at least partially made from translucent materials to help an operator monitor the amount of cleaning solution contained within each reservoir. The reservoirs 18-20 can be connected to the cleaning device 10 in several different ways. For example, they can be threaded onto the cleaning device 10, they can be retained by a frictional engagement or an interfering engagement, or they can be retained by straps or other restraints. Some cleaning devices can also have color coded areas to match certain reservoirs or even provide lock-out features (also referred to as a lockout device herein) to prevent certain reservoirs from be situated in some positions within the housing.

Figure 6:
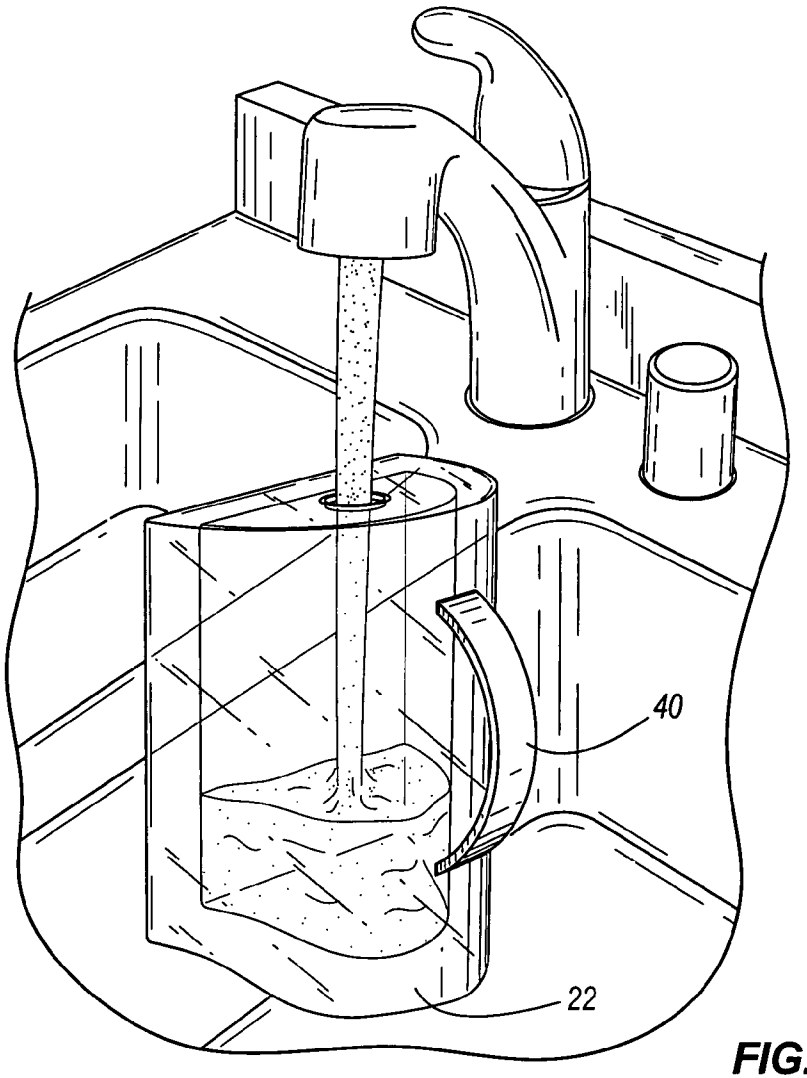
FIG. 6 is a perspective view of the rinse solution reservoir shown in FIG. 5.
Figure 5:
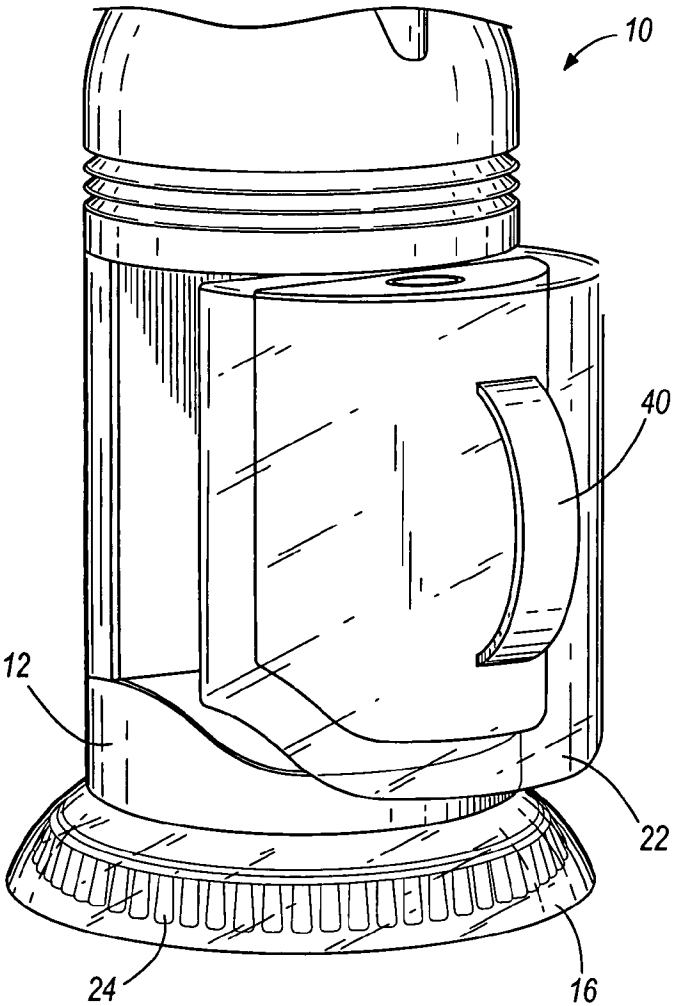
FIG. 5 is a partially exploded perspective view of the cleaning device shown in FIG. 3.

As shown in FIG. 5, the rinse solution reservoir 22 of this embodiment is positioned on an opposite side of the housing 12 relative to the cleaning solution reservoirs 18-20. The rinse solution reservoir 22 is designed to be easily removed from the housing 12. Specifically, the reservoir 22 has a handle 40 that allows for easy removal of the reservoir 22. The handle 40 extends outside the periphery of the housing 12 as shown. Removal of the reservoir 22 allows it to be easily filled at a faucet as shown in FIG. 6. Once the reservoir is filled, it can be inserted into the housing 12 and be retained many different ways known in the art. Like the cleaning solution reservoirs, this reservoir 22 can also be at least partially made from translucent materials to allow an operator to visually inspect the contents of the reservoir 22.

Figure 7:
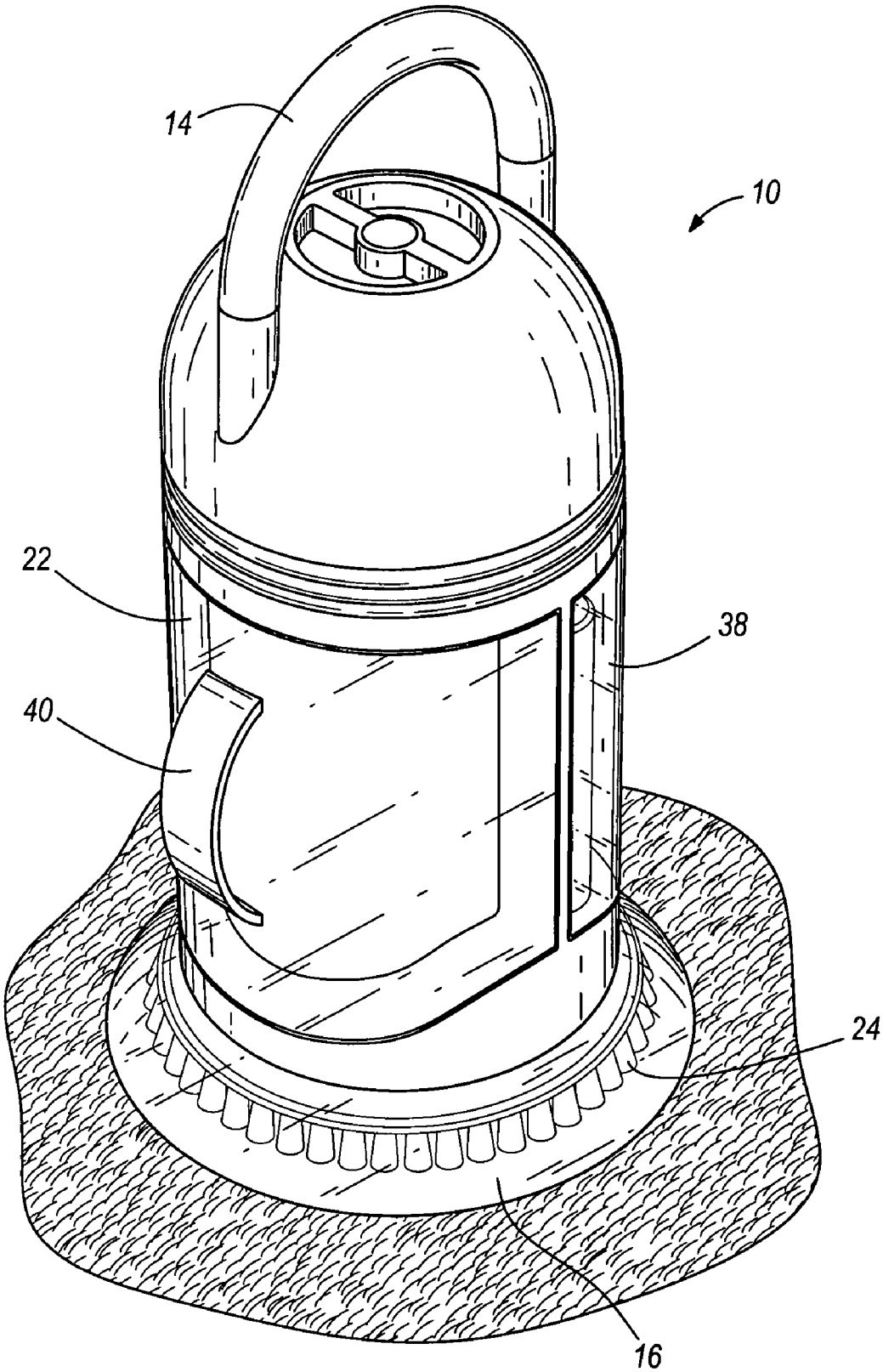
FIG. 7 is a perspective view of the cleaning device shown in FIG. 3.

As shown in FIGS. 4, 5, and 7, this embodiment also has an agitation device 24 positioned within head 16. The agitation device 24 comprises a rotary brush located adjacent the periphery of the head 16. The brush can be driven by a motor (not illustrated).

Although it is not shown in FIGS. 3-7, this embodiment can also house other device described above with respect to the first embodiment. For example, a vacuum source, recovery tank, and the like can be provided within the housing 12. Additionally, a control can be positioned on the housing to allow a user to select between cleaning solutions and/or cleaning operations. The control can be configured many different ways. For example, it can be configured like the control shown in FIG. 8.

Figure 9:
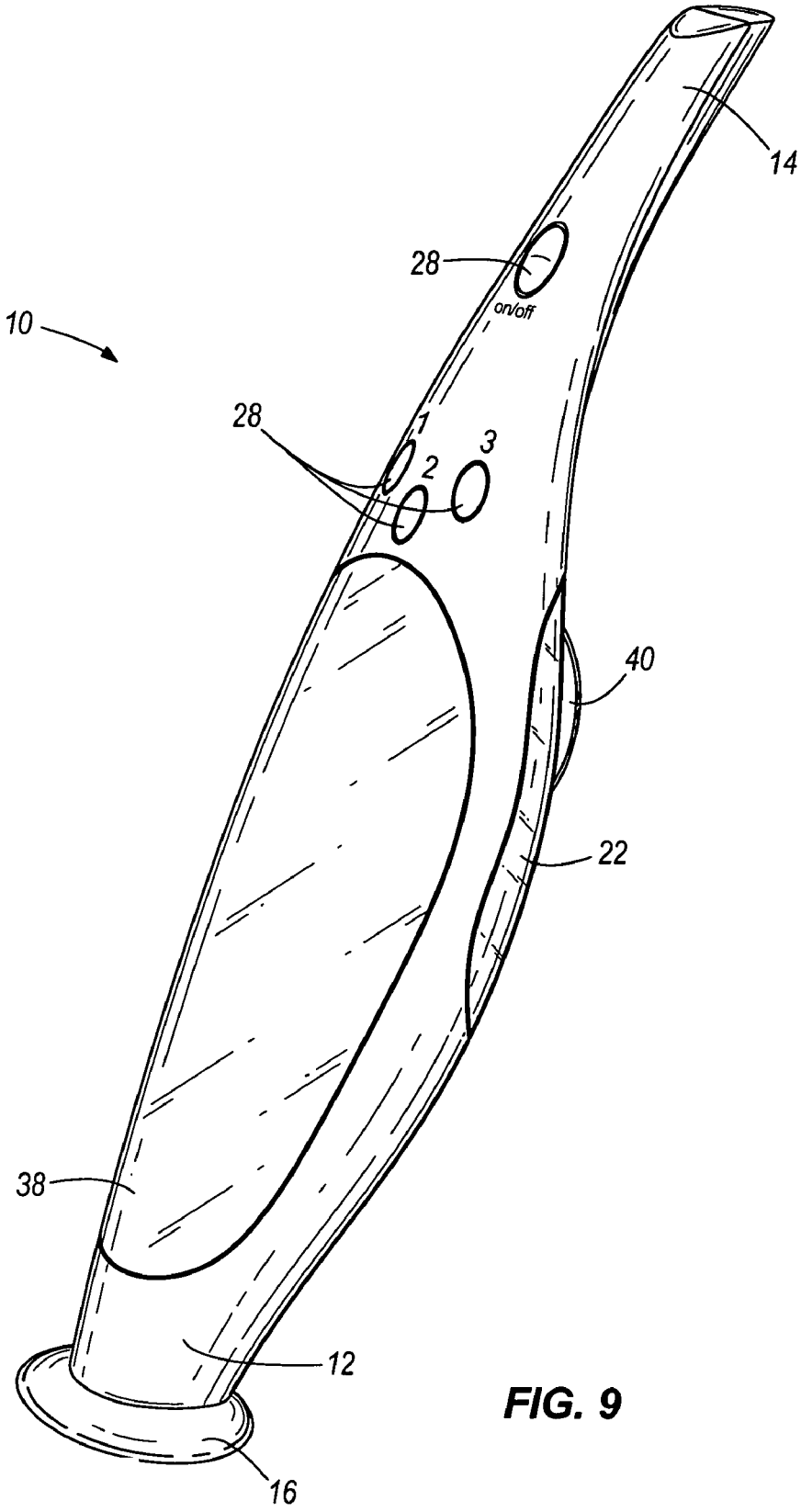
FIG. 9 is a perspective view of a third embodiment of an extraction cleaning device embodying aspects of the present invention.
Figure 10:
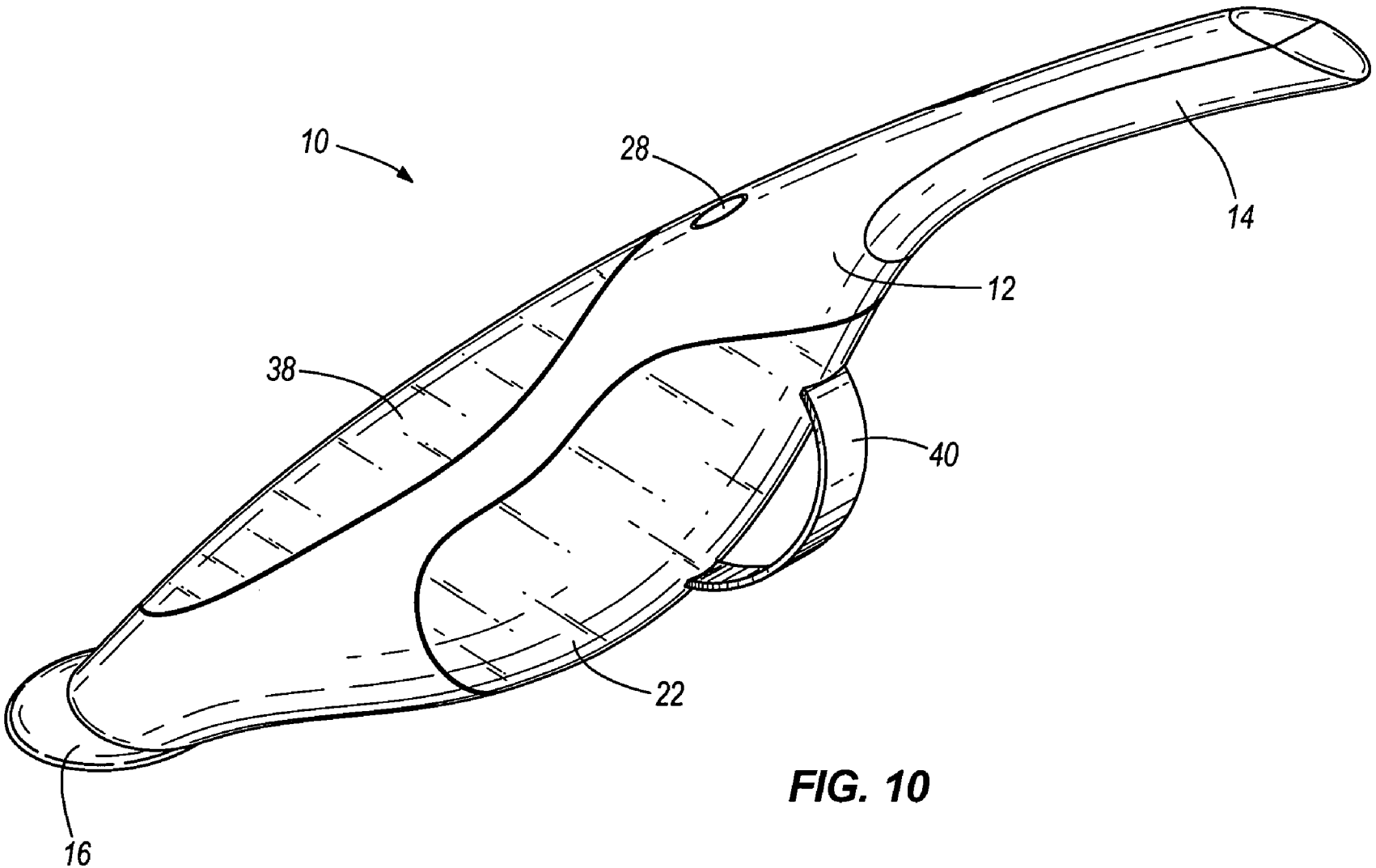
FIG. 10 is a perspective view of the cleaning device shown in FIG. 9.
Figure 11:
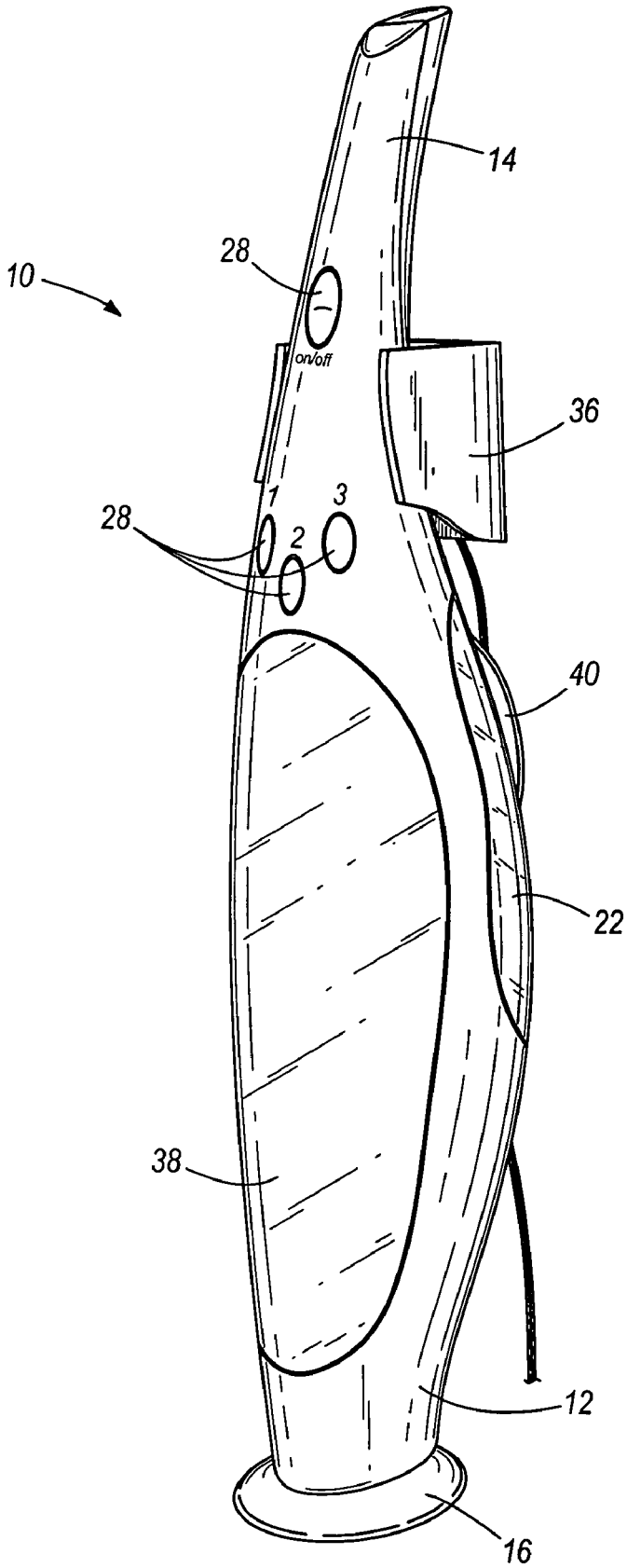
FIG. 11 is a perspective view of the cleaning device shown in FIG. 9, where the cleaning device is coupled to a charger.

FIGS. 9-11 illustrate a third embodiment of a cleaning device embodying aspects of the invention. This embodiment has many similarities to the previous embodiments. Accordingly, similar elements will be given similar reference numerals. However, this does not dictate that these elements must be identical in configuration or operation. Furthermore, since most of the elements were discussed with respect to the previous embodiment, certain details may be omitted for the sake of brevity.

As illustrated in FIGS. 9-11, the cleaning device 10 has a elongated housing 12 similar to the embodiment illustrated in FIGS. 1 and 2, but also has a panel 38 positioned over the cleaning solution area similar to the embodiment illustrated in FIGS. 3-7. Additionally, the rinse fluid reservoir 22 also has many similarities to the embodiment illustrated in FIGS. 3-7. For example, it is only partially retained within the housing 12 and it has a handle for easy removal from the housing 12.

Briefly, this embodiment has an elongated housing 12 having a movable panel 38 positioned over an area designed to receive a plurality of cleaning solution reservoirs. As mentioned above, the housing 12 also receives a rinse fluid reservoir 22. Furthermore, although it is not illustrate with respect to this embodiment, the cleaning device 10 also has an agitation device positioned within head 16. Additionally, an extracted fluid reservoir and vacuum source are also positioned within the housing. Finally, as illustrated, several push button controls 28 are coupled to the house to control specific functions of the cleaning device 10.

FIG. 11 shows the cleaning device coupled to a charger or docking station 36. As illustrated, the cleaning device 10 engages the charger 36 in a manner that allows the cleaning device 10 to be suspended by charger 36 while being charged.

Figure 12:
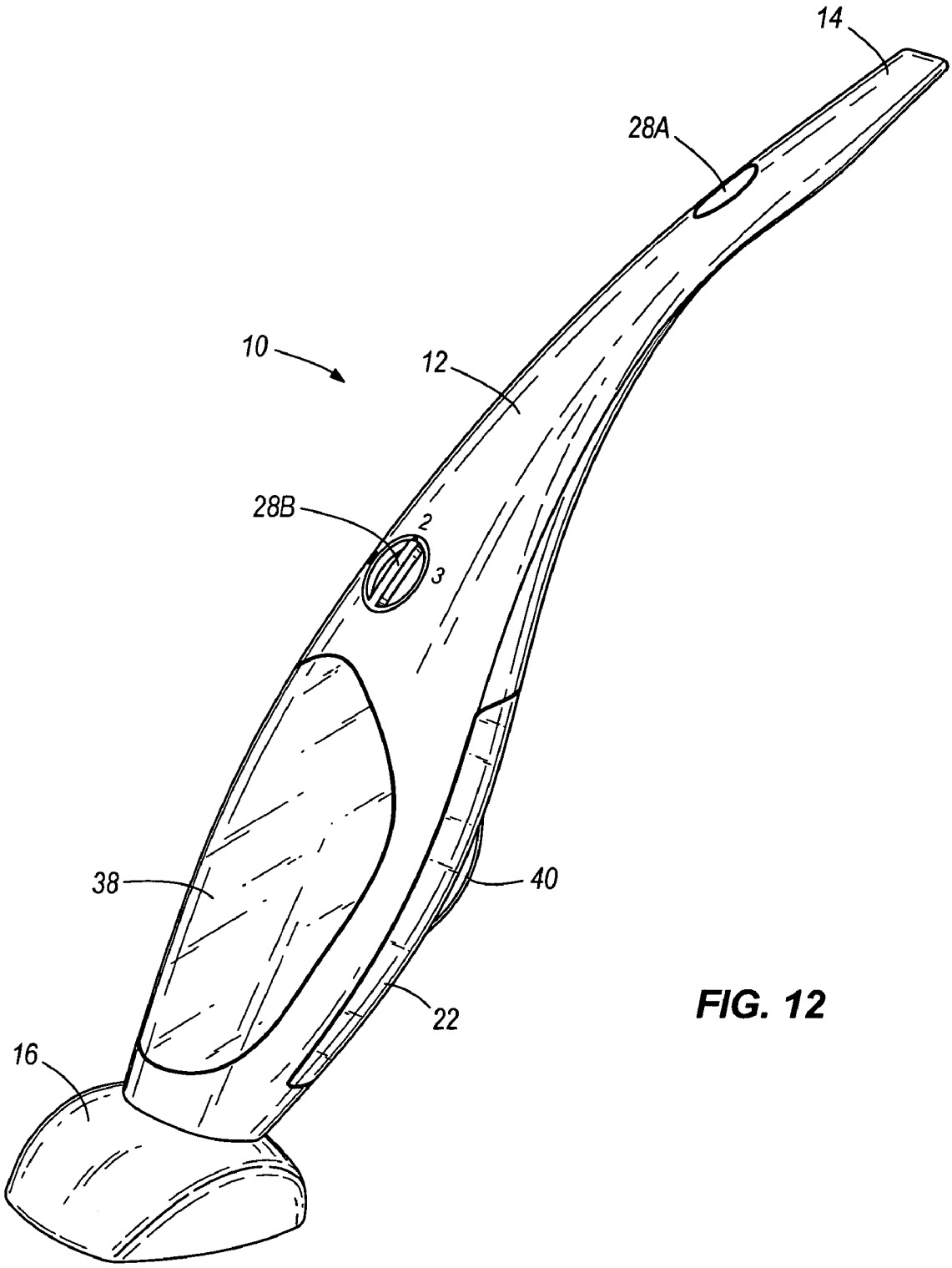
FIG. 12 is a perspective view of a fourth embodiment of an extraction cleaning device embodying aspects of the present invention.
Figure 13:
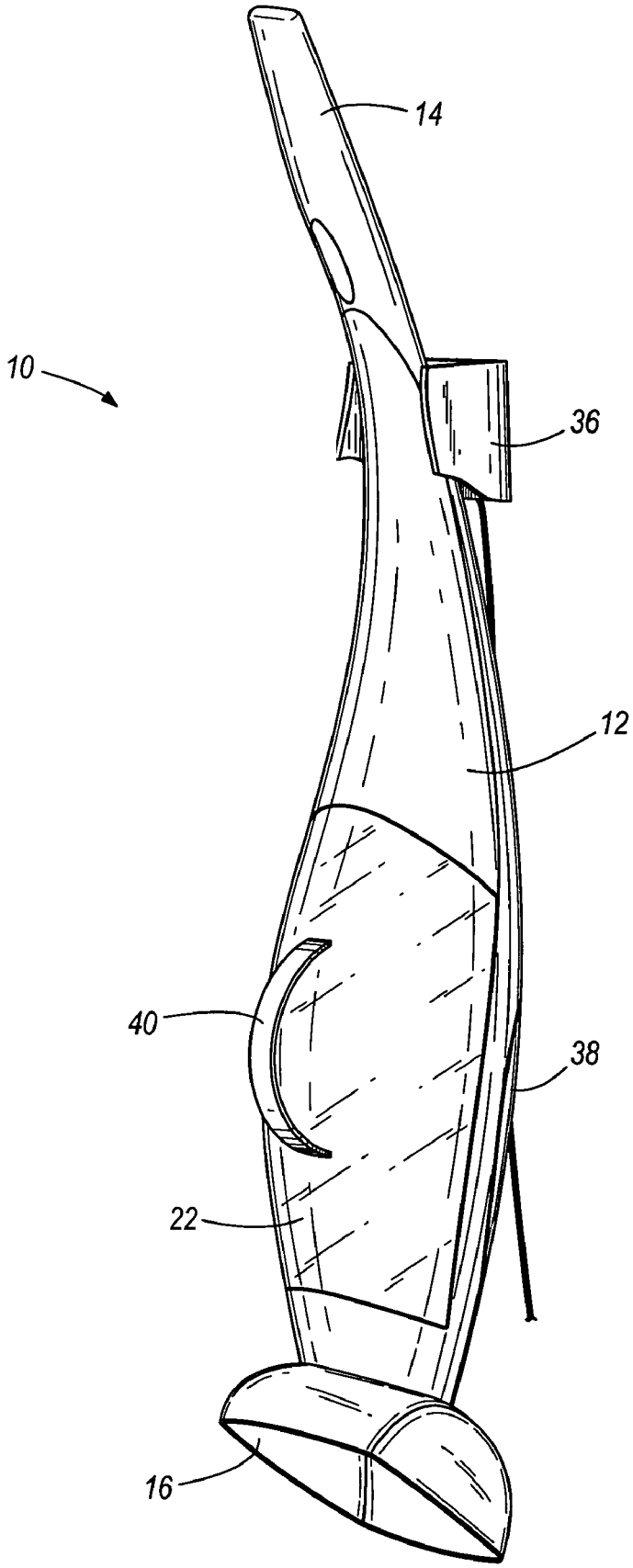
FIG. 13 is a perspective view of the cleaning device shown in FIG. 12, where the cleaning device is coupled to a charger.

FIGS. 12 and 13 illustrate a fourth embodiment of a cleaning device embodying aspects of the invention. This embodiment has many similarities to the previous embodiments. Accordingly, similar elements will be given similar reference numerals. However, this does not dictate that these elements must be identical in configuration or operation. Furthermore, since most of the elements were discussed with respect to the previous embodiment, certain details may be omitted for the sake of brevity.

As shown in FIGS. 12 and 13 this embodiment is quite similar to the embodiment illustrated in FIGS. 9-11. While some of the similar feature may be discussed, generally only the major difference between these two embodiments will be discussed below.

The embodiment illustrated in FIGS. 12 and 13 has a larger head 16 than the previous embodiment for engagement with the floor. Accordingly, larger agitation devices can be positioned within the head 16. Furthermore, this embodiment uses a combination of a push button 28A and a dial 28B to control the operation the cleaning device 10. The push button 28A is for on/off control, while the dial 28B allows for cleaning solution selection.

FIG. 13 illustrates yet another difference between the embodiments illustrated in FIGS. 9-11 and FIGS. 12 and 13. Specifically, the charger 36 engages opposite sides of the cleaning device 10 in each embodiment.

Figure 14:
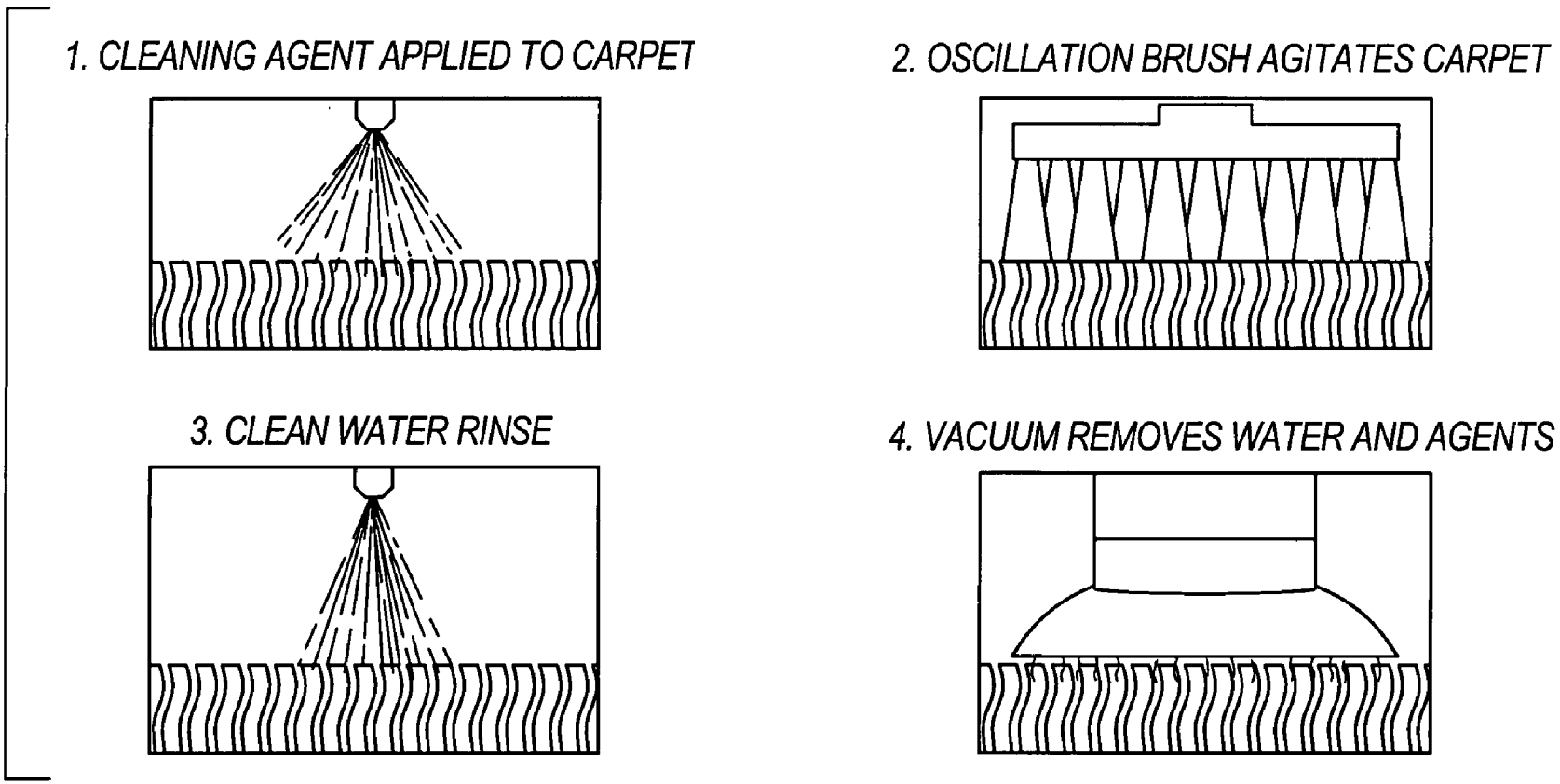
FIG. 14 is a flow chart showing sequential steps in a cleaning operation.

The operation of an exemplary embodiment will now be described with reference to FIGS. 8 and 14. In operation, an operator of the extraction cleaning device 10 can manipulate the control 28 to dispense a specific cleaning solution contained within one of the cleaning fluid reservoirs 18-21 upon encountering a spot. If the stain can be specifically identified, the operator can choose a specific cleaning solution within the device 10 that is designated for that type of stain. However, if the stain cannot be identified, the operator can progressively apply each cleaning solution, if necessary, to properly remove the stain.

Once a cleaning solution is applied to the spot, the agitation device 24 can be actuated and applied to the stained area. The agitation device 24 can help to work the cleaning solution into the soiled area. The agitation device can also help to loosen the stain from the floor.

Following or during agitation of the spot, a rinse fluid such as water can be dispensed from the cleaning device 10. The rinse fluid can be triggered to be dispensed automatically or via the control 28 or other actuator. Once the rinse fluid is triggered, it is dispensed from the rinse fluid reservoir 22 onto the floor. The rinse fluid can help to further remove the spot from the floor as well as help to remove the cleaning solution from the floor.

Finally, the spot, the cleaning solution, and the rinse fluid can be extracted upon application of suction from the vacuum. The extract fluid, which will include soil and other debris, will be delivered to the extracted fluid reservoir 23 via a conduit 34.

Each of these steps can be automatically initiated upon selection of a cleaning solution via control 28. In other words, upon selection of a cleaning solution, the solution will be automatically dispensed and the agitation, rinse, and extraction can be automatically initiated thereafter. However, in some embodiments, the operator can either manually initiate each step and/or override the automatic initiation of steps.

As illustrated in the embodiments shown in FIGS. 3-13, the head 16 that engages the floor is relatively small compared to FIGS. 1 and 2, as well as other conventional extraction cleaning devices. Accordingly, these types of cleaning devices are specifically adapted for spot removal opposed to cleaning an entire floor. However, these embodiments can also be used to clean an entire floor if desired.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

Various features of the invention are set forth in the following claims.

What is claimed is:

1. A spot extraction cleaning device comprising:

a housing, a head coupled to the housing and adapted for engagement with a surface containing a spot;

a plurality of cleaning solution reservoirs coupled to the housing and in fluid communication with the head, wherein each cleaning solution reservoir contains a different cleaning solution; and a control coupled to the housing to allow an operator of the cleaning device to selectively control which cleaning solution is dispensed, wherein cleaning solutions reservoirs are selectively removable from the housing, and wherein the cleaning device and cleaning solution reservoirs include a lockout device to prevent cleaning solution reservoirs from being improperly placed in the cleaning device.

2. The spot extraction cleaning device of claim 1, wherein the control comprises a rotatable dial having a position corresponding to each of the plurality of cleaning solutions.

3. The spot extraction cleaning device of claim 1, further comprising an agitation brush positioned adjacent the head and adapted to contact the surface during cleaning operations.

4. The spot extraction cleaning device of claim 1, further comprising a rinse fluid reservoir coupled to the housing and in fluid communication with the head.

5. The spot extraction cleaning device of claim 4, further comprising an extracted fluid reservoir coupled to the housing and in fluid communication with the head.

6. The spot extraction cleaning device of claim 5, wherein the cleaning device is automatically controlled, such that when the operator selects a cleaning solution to be dispensed, the cleaning device automatically dispenses the cleaning solution, automatically dispenses the rinse fluid, and automatically extracts the cleaning solution and rinse fluid.

7. The spot extraction cleaning device of claim 1, wherein the cleaning solution reservoirs are color coded.

8. The spot extraction cleaning device of claim 1, wherein the cleaning solution reservoirs are clear to allow the contents of each reservoir to be viewed.

9. The spot extraction cleaning device of claim 1, wherein the cleaning device is powered via a battery.

10. The spot extraction cleaning device of claim 9, wherein the battery is disconnected from the device to be recharged.

11. The spot extraction cleaning device of claim 10, wherein the cleaning device is coupled to a power source to recharge the battery.

12. The spot extraction cleaning device of claim 1, wherein the control comprises a plurality of push buttons corresponding the plurality of cleaning solutions.

* * * * *